United States Patent [19]

Quantz

[11] 4,008,298

[45] Feb. 15, 1977

[54] CARBURETOR

[75] Inventor: Norman G. Quantz, Algonac, Mich.

[73] Assignee: Lectron Products, Inc., Troy, Mich.

[22] Filed: May 16, 1975

[21] Appl. No.: 578,265

[52] U.S. Cl. ..... 261/44 R; 261/DIG. 38; 251/85; 251/DIG. 4

[51] Int. Cl.[2] ..... F02M 9/06

[58] Field of Search ..... 251/DIG. 4, 85; 261/44 R, 50 A, DIG. 38

[56] References Cited

UNITED STATES PATENTS

| | | | |
|---|---|---|---|
| 1,375,898 | 4/1921 | Ciglia et al. | 261/44 R |
| 1,828,889 | 10/1931 | Ciglia et al. | 261/44 R |
| 2,639,884 | 5/1953 | Mitchell | 251/85 |
| 2,839,265 | 6/1958 | Hobbs | 251/85 |
| 2,868,522 | 1/1959 | O'Neil | 261/50 A |
| 2,987,304 | 6/1961 | Roy | 261/44 R |
| 3,469,825 | 9/1969 | Du Bois | 261/DIG. 38 |
| 3,528,787 | 9/1970 | Hallberg | 261/50 A |
| 3,669,424 | 6/1972 | Shiobara et al. | 261/44 R |
| 3,709,469 | 1/1973 | Edmonston et al. | 261/DIG. 38 |
| 3,815,873 | 6/1974 | Hendrick | 251/85 |

FOREIGN PATENTS OR APPLICATIONS

| | | | |
|---|---|---|---|
| 1,144,405 | 3/1969 | United Kingdom | 261/44 R |

*Primary Examiner*—Tim R. Miles
*Attorney, Agent, or Firm*—Harness, Dickey & Pierce

[57] ABSTRACT

A carburetor of the slide and pin type having a throttle slide mounted in grooves on opposite sides of the throat and carrying a pin extending into a fuel discharge nozzle tube. The tube is formed as an integral part of the housing. A novel mounting means is provided in the slide for the upper portion of the tapered pin to provide a floating action which accommodates tolerance variations while assuring proper alignment of the pin and maintaining the close fit necessary for proper operation. An adjustable idle stop in the form of a spring-held screw coacts with the slide and is mountable on either side of the body.

12 Claims, 13 Drawing Figures

CARBURETOR

BACKGROUND OF THE INVENTION

Field of the Invention

The invention relates to carburetor constructions, and more particularly to carburetors of the type having a through passage for air and an adjustable throttle slide at an intermediate position which varies the flow-through area and simultaneously adjusts the amount of fuel which enters the passage at that intermediate point and is mixed with the flowing air. More particularly, the invention is concerned with the construction of the nozzle means which controls the flow of fuel and its relation to the throttle slide.

BRIEF SUMMARY OF THE INVENTION

It is an object of the present invention to provide a novel and improved carburetor of the slide and pin type which assures proper alignment of the pin with respect to the nozzle tube at all stages in the operation, compensating for manufacturing tolerances in the slide mounting while still maintaining the close fit necessary for proper operation, particularly at idle speeds.

It is a further object to provide an improved carburetor of this type which minimizes leakage problems, especially in the vicinity of the fuel nozzle tube.

It is also an object to provide a novel carburetor construction of this character which has simplified means for adjusting the idle setting, this means being alternately mountable on either side of the carburetor body.

Briefly, the illustrated embodiment of the invention comprises a carburetor having a body with inlet and outlet ends, a throat extending through said body from one end to the other, a throttle slide in said body extending transversely to said throat at an intermediate portion thereof, said slide being movable to vary the unblocked portion of said throat, guide means on opposite sides of said throat coacting with complementary guide means on said slide to support the slide during said movement, a fuel tube extending transversely to said throat and having an opening into the throat, a pin disposed in said tube and being tapered with the widest portion of the taper adjacent said opening, and means mounting the end of said pin adjacent said widest portion of the taper on said slide, said mounting means being so constructed as to permit limited movement of said end of the pin with respect to said slide in directions transverse to the extent of said tube, so as to compensate for tolerance variations between said guide means on the throat and said opening.

In another aspect, the invention comprises a carburetor having a body with inlet and outlet ends, a throat extending through said body from one end to the other, a throttle slide in said body extending transversely to said throat at an intermediate portion thereof, said slide being movable to vary the unblocked portion of said throat, and adjustable idle stop means for said slide comprising threaded apertures on opposite sides of said body, slots on opposite sides of said slide facing said apertures, inclined upper surfaces on said slots, a screw threaded in one of said apertures and having a tapered end coacting with one of said surfaces, and means holding said screw in an adjusted position.

In still another aspect, the invention comprises a carburetor having a body with inlet and outlet ends, a throat extending through said body from one end to the other, a throttle slide in said body extending transversely to said throat at an intermediate portion thereof, said slide being movable to vary the unblocked portion of said throat, a pin carried by said slide, and a nozzle tube formed as an integral part of said body and receiving said pin.

DESCRIPTION OF THE PREFERRED EMBODIMENTS

Figure 1:
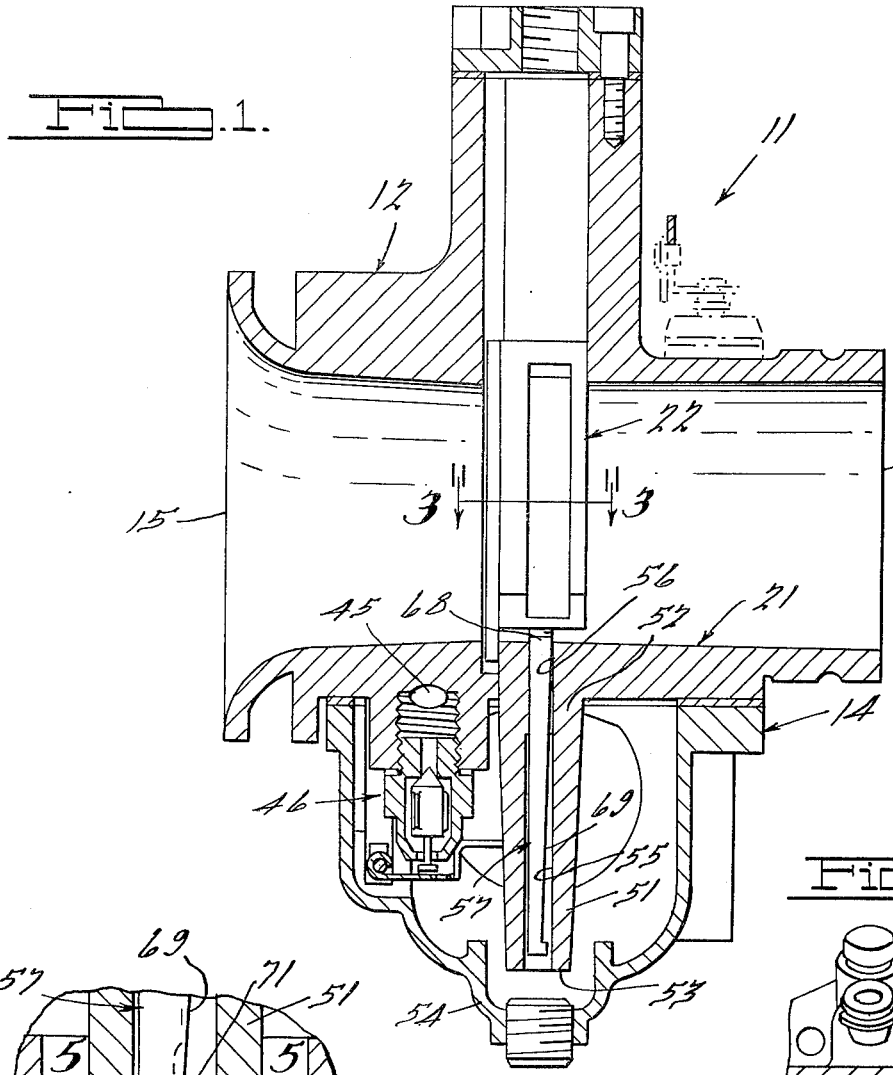
FIG. 1 is a cross sectional view in elevation of a carburetor incorporating the principles of this invention and showing the integral construction of the nozzle tube and body.

The carburetor is generally indicated at 11 and comprises a body generally indicated at 12, a cover generally indicated at 13 above the body, and a bowl generally indicated at 14 secured to the underside of the body. Body 12 is of elongated shape, having an air inlet end 15 and an outlet end 16, both ends being open. A slide supporting portion generally indicated at 17 is formed on body 12 intermediate ends 15 and 16 and extends thereabove. Suitably, body 12 may be fabricated of two parts having abutting surfaces at slide supporting portion 17, these parts being united by fasteners 18.

Figure 3:
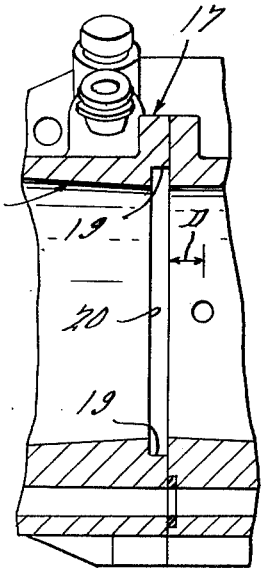
FIG. 3 is a fragmentary cross sectional plan view taken along the line 3—3 of FIG. 1 and showing the relative locations of the throttle slide slots and nozzle tube entrance, the slide and associated parts being removed.
Figure 2:
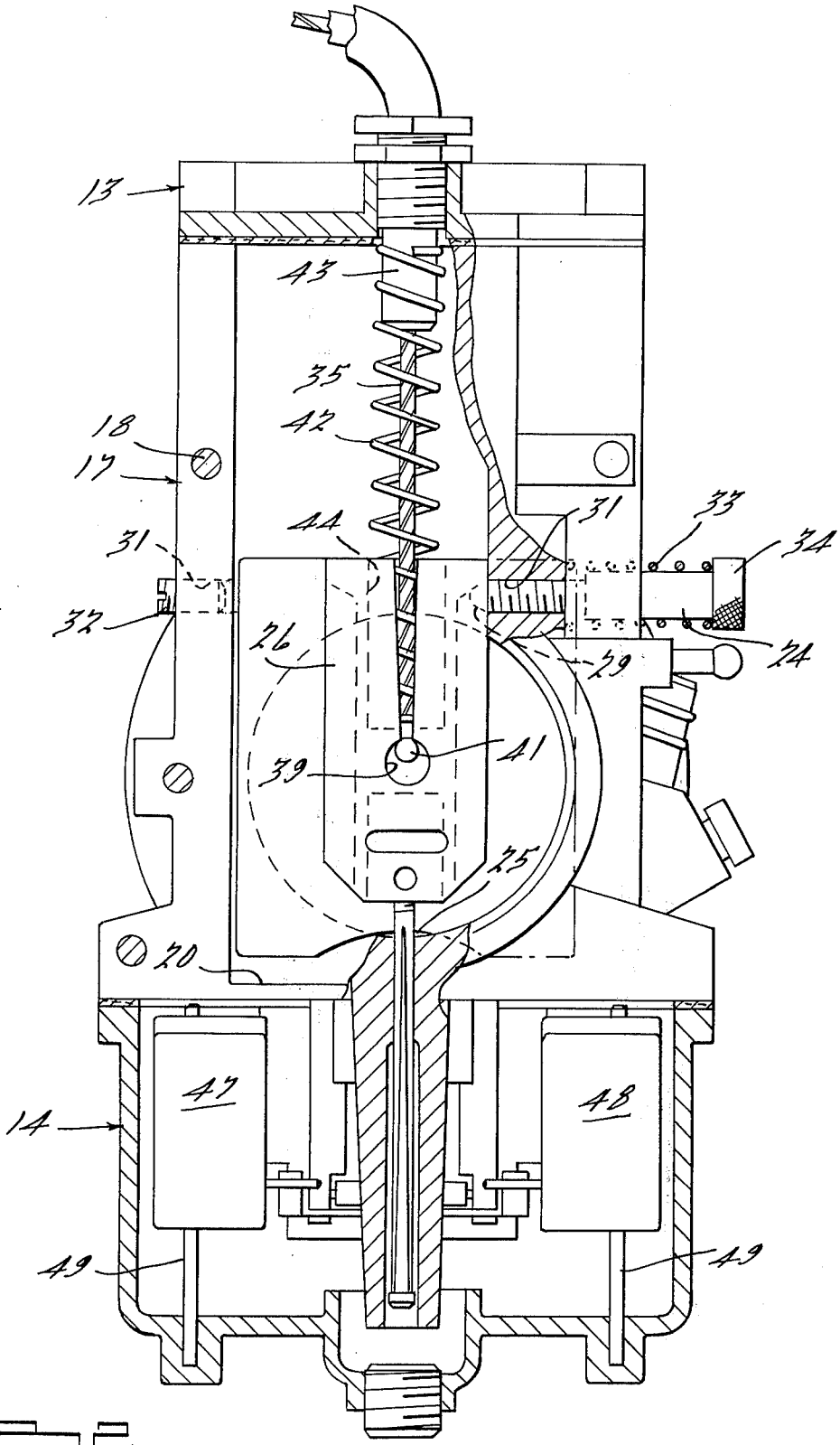
FIG. 2 is a front elevational view looking toward the entrance of the carburetor throat, portions of the carburetor being removed and sectioned for purposes of clarity.
Figure 8:
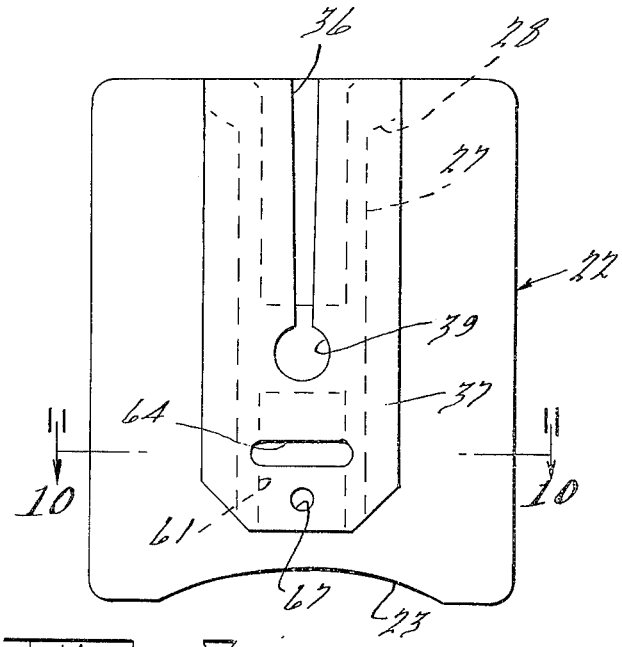
FIG. 8 is a front elevational view of the slide.

Slide supporting portion 17 is provided with a pair of facing side grooves 19 (FIG. 3) and a connecting bottom groove 20 open to the carburetor throat, which is generally indicated at 21. A throttle slide generally indicated at 22 is mounted in these grooves and is vertically adjustable to vary the unblocked portion of throat 21. The width of slide 22 is slightly greater than that of the intermediate portion of throat 21, and the slide has a generally rectangular shape as seen in FIG. 8. A concave arcuate recess 23 is centrally formed along the lower edge of slide 22. An idle adjusting screw 24 is threadably mounted in the side of slide supporting portion 17 and limits downward movement of slide 22, thus defining the idle position. This position may be chosen so that a slight gap 25 exists between the central portion of recess 23 and the bottom of throat 21. Alternatively, for purposes such as racing, the setting may be for complete shutoff at idle, with recess 23 within slot 20.

Figure 5:
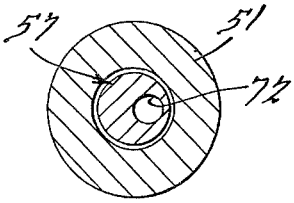
FIG. 5 is a bottom cross sectional plan view taken along the line 5—5 of FIG. 4.

Slide 22 is quite thin but has a central enlargement 26 on its downstream side which extends from the top of the slide toward recess 23. A groove 27 is formed in each side of this enlargement for the reception of the inner end of idle adjusting screw 24, the top 28 of this groove being sloped as seen in FIG. 5 to coact with the adjusting screw.

More particularly, the adjusting screw has a tapered end 29 complementary to top 28 of each groove so that by moving the screw in or out, the idle position may be varied. A threaded aperture 31 is formed in each side of slide supporting portion 17, so that the screw may be mounted on either side of the carburetor, depending on accessibility requirements. The unused aperture may be closed with a threaded plug 32. A helical coil compression spring 33 surrounds the outer unthreaded portion of screw 24 and is held between the head 34 of the screw and slide supporting portion 17. Spring 33 will serve to hold the screw in its adjusted position.

Figure 9:
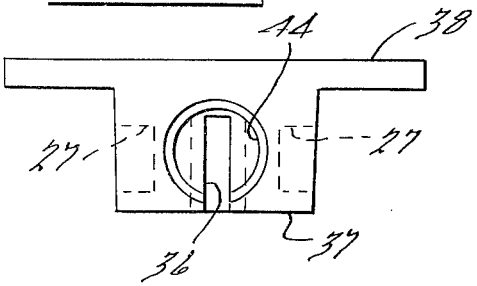
FIG. 9 is a top plan view of the slide.
Figure 10:
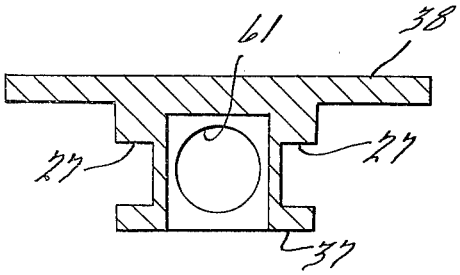
FIG. 10 is a cross sectional plan view of the slide taken along the line 10—10 of FIG. 8.
Figure 11:
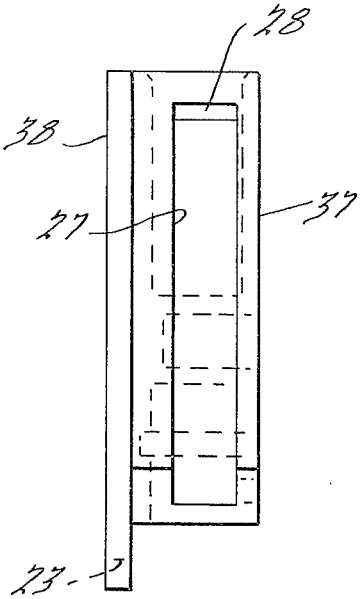
FIG. 11 is a side elevational view of the slide.
Figure 12:
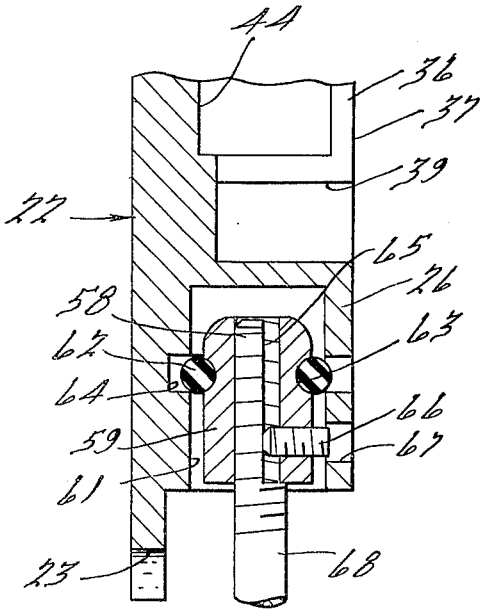
FIG. 12 is an enlarged fragmentary cross sectional view in elevation showing the floating connection between the top of the pin and the slide.
Figure 13:
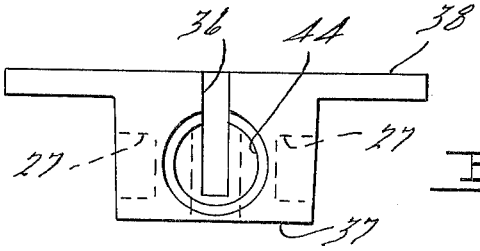
FIG. 13 is a view similar to FIG. 9 but showing the cable slot opening toward the back of the slide.

A cable 35 is provided for vertically adjusting slide 22. Enlargement 26 has a recess 36 for this cable, the recess being shown in FIG. 9 as opening toward the downstream side 37 of the enlargement. Alternatively, as shown in FIG. 13, recess 36 may open toward the upstream side 38 of the slide. The lower end of recess 36 is enlarged at 39 to receive the enlarged cable end 41. A helical coil compression spring 42 is disposed between cover 13 and slide 22, the upper end of this spring surrounding a guide 43, the lower end being received by a recess 44 in enlargement 26. Spring 42 urges slide 22 downwardly so that its position will be controlled either by cable 36 or idle adjustment screw 24.

Bowl 14 is provided with a fuel inlet passage 45 leading to a float needle valve generally indicated at 46. This valve is controlled by a pair of floats 47 and 48 guided by pins 49 within the bowl. The arrangement is such that floats 47 and 48, when lifted by the rising level of fuel in bowl 14, will close valve 46, thus controlling the level of fuel in the bowl.

A fuel discharge nozzle tube 51 extends downwardly from the lower portion of body 12 into bowl 14. This tube is formed as an integral part of body 12, thereby eliminating any leakage problems between the tube and body. The exterior of tube 51 tapers downwardly from its juncture 52 with the body, and bottom 53 of the tube is disposed within a cup-shaped portion 54 of bowl 14. A relatively wide channel 55 within the tube leads upwardly to a narrow nozzle pin guide passage 56, the latter opening onto and being flush with carburetor throat 21.

A nozzle pin generally indicated at 57 is secured to extension 26 of slide 22 and extends downwardly into nozzle 51. Pin 57 has a threaded upper end 58 mounted in a slide insert 59, the latter being disposed within a bore 61 on the underside of slide extension 26. A substantial clearance is provided between bore 61 and the outer surface of insert 59. The insert is held against lengthwise movement with respect to slide 22 and at the same time supported for limited lateral movement by an O-ring 62. This O-ring is disposed within a groove 63 on the exterior of insert 59 so that it tightly grips the insert. The outer portion of O-ring 62 is disposed in a groove 64 at an intermediate portion of bore 61. Slot 64 is open toward face 37 of enlargement 26, in order to permit assembly of the O-ring and other parts. The width of groove 64 in all directions is sufficient to permit the floating action to take place. A flat portion 65 is provided on threaded portion 58, and a set screw 66 is threadably mounted in insert 59 and adapted to engage the flat portion so as to hold the pin in its screw-adjusted position within the insert. An access hole 67 is provided in slide portion 26 for set screw 66.

The position of pin 57 at idle, that is, when slide 22 is in its fully lowered position, will be determined by the rotated position of the pin. This adjustment will normally be made to obtain the desired richness of mixture at idle and low speed settings, and to prevent a power "flat" spot upon acceleration. The manner in which insert 59 is supported by O-ring 62 allows float in the nature of a universal joint which compensates for tolerance variations in the nozzle pin guide means and slight warp which may occur in the pin during operation and might otherwise cause it to bind, thus insuring uniform manufacturing characteristics, permitting closer tolerances between pin 57 and tube 51, and allowing vertical adjustment of the pin relative to the slide. The O-ring will also isolate harmonic vibrations of the pin with respect to the body and slide.

The floating support construction for the pin in slide 22 is especially advantageous where, as is the usual case, the distance between the upper end 56 of the fuel passage and the guide slots 19, 20 (this distance being indicated at D in FIG. 3) has a relatively wide tolerance variation as compared with the fit between the pin 57 and passage 56. For optimum operation, particularly at idle, of the carburetor, it is essential that the fit between pin 57 and tube 51 be kept to close tolerances, and the novel supporting means for the upper end of the pin will permit these close fits to be maintained. The construction will also minimize pulsations or vibrations of the pin which might adversely affect the air-fuel ratio.

Below threaded portion 58, pin 57 has a cylindrical upper portion 68 and a flat taper 69 therebelow extending to a radial shoulder 71 near the bottom. The depth of taper 69 will affect performance at higher speeds, deeper tapers resulting in richer fuel-air mixtures. Raising the pin relative to slide recess 23 will also enrich the mixture at any given slide setting.

The fit between portion 68 of the pin and bore portion 56 is very close, perhaps 0.001 inches or less. In the normal idle position, this cylindrical pin portion is slightly above bore portion 56. For full fuel shutoff in racing applications, however, the cylindrical pin portion may extend slightly into bore portion 56. If slide recess 23 is within groove 20, complete fuel and air shutoff will result. When in idle position, the bottom of pin 57 will be slightly above the bottom 53 of tube 51, there being considerably more tolerance between the pin and bore portion 55 than with bore portion 56. During sudden acceleration, when slide 22 is raised quickly, shoulder 71 may have a pumping action on the fuel within bore portion 55, thus increasing fuel flow to the carburetor throat. The fact that tube 51 is integral with body 12 will minimize vibration and the subsequent fuel pumping action which could lead to undesired variations in air-fuel ratio.

Figure 4:
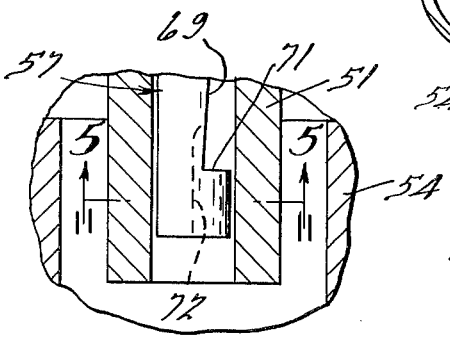
FIG. 4 is an enlarged fragmentary cross sectional view in elevation taken in the vicinity of the lower end of the pin.
Figure 6:
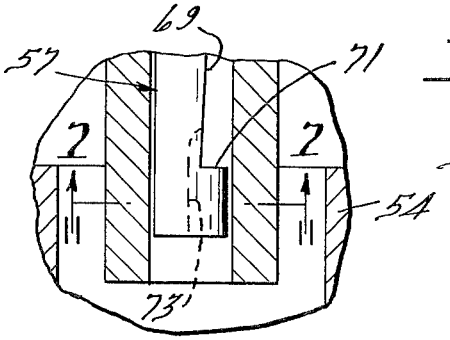
FIG. 6 is a view similar to FIG. 4 but showing a different type of construction for the pin bottom.
Figure 7:
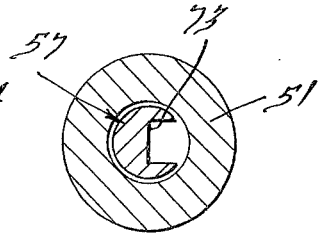
FIG. 7 is a bottom cross sectional plan view taken along the line 7—7 of FIG. 6.

FIGS. 4 through 7 show two manners in which fuel may pass from the bottom of pin 57 into the space between its tapered surface 69 and the inner tube wall. In FIGS. 4 and 5, a drilled hole 72 extends from the bottom of pin 57 to shoulder 71. In FIGS. 6 and 7, a milled slot 73 is provided in place of hole 72.

In operation, air will flow into entrance 15 of throat 21 and pass that portion of pin 57 which is lifted by slide 22 into the air stream. The movement of air past the pin will cause a zone of reduced pressure adjacent flat tapered undersurface 69, serving to draw the fuel from the float chamber and deliver it to the main air passage in finely divided, atomized particles.

While it will be apparent that the preferred embodiment of the invention disclosed is well calculated to fulfill the objects above stated, it will be appreciated that the invention is susceptible to modification, variation and change without departure from the proper scope or fair meaning of the subjoined claims.

I claim:

1. A carburetor comprising a body with inlet and outlet ends, a throat extending through said body from one end to the other, a throttle slide in said body extending transversely to said throat at an intermediate portion thereof, said slide being movable to vary the unblocked portion of said throat, guide means on opposite sides of said throat coacting with complementary guide means on said slide to support the slide during said movement, a fuel tube extending transversely to said throat and having an opening into the throat, a pin disposed in said tube and being tapered with the widest portion of the taper adjacent said opening, and means mounting the end of said pin adjacent said widest portion of the taper, said mounting means being so constructed as to permit limited translatory as well as pivotal movement of said end of the pin with respect to said slide in directions transverse to the extent of said tube, so as to compensate for tolerance variations between said guide means on the throat and said opening, said mounting means comprising a bore in the underside of said slide, an enlargement on said end of the pin within and narrower than said bore, and interfitting ring-and-groove means on said enlargement and bore permitting said translatory and pivotal movements.

2. In a carburetor for an internal combustion engine, said carburetor being of the type having a throat through which air passes en route to a combustion chamber in the engine, a throttle slide movable across said throat to regulate flow of air therethrough, and a fuel passage opening into said throat opposite said slide, a pin carried by said slide extending into said fuel passage and movable with said slide into and out of said passage, said pin having fuel metering means associated therewith at one side thereof downstream of said slide for regulating flow of fuel from said passage into the stream of air traversing said throat, an improved mounting connecting said pin to said slide comprising means supporting said pin for universal adjustment radially of the pin axis, whereby said pin positions itself automatically and is disposed in use in alignment with and coaxially to said fuel passage; and means coactive with said pin and said slide for holding said pin in use with said fuel metering means on the downstream side of the pin in adjusted positions of said pin, the means supporting said pin being in the form of an O-ring confined in confronting inner and outer annular grooves associated with said pin and said slide respectively.

3. A carburetor comprising a body with inlet and outlet ends, a throat extending through said body from one end to the other, a throttle slide in said body extending transversely to said throat and an intermediate portion thereof, said slide being movable to vary the unblocked portion of said throat, and adjustable idle stop means for said slide comprising threaded apertures on opposite sides of said body, slots on opposite sides of said slide facing said apertures, inclined upper surfaces on said slots, a screw threaded in one of said apertures and having a tapered end coacting with one of said surfaces, and means holding said screw in an adjusted position.

4. A carburetor comprising a body with inlet and outlet ends, a throat extending through said body from one end to the other, a throttle slide in said body extending transversely to said throat at an intermediate portion thereof, said slide being movable to vary the unblocked portion of said throat, guide means on opposite sides of said throat coacting with complementary guide means on said slide to support the slide during said movement, a fuel tube extending transversely to said throat and having an opening into the throat, a pin disposed in said tube and being tapered with the widest portion of the taper adjacent said opening, and means mounting the end of said pin adjacent said widest portion of the taper, said mounting means being so constructed as to permit limited movement of said end of the pin with respect to said slide in directions transverse to the extent of said tube, so as to compensate for tolerance variations between said guide means on the throat and said opening, said mounting means comprising a bore on the underside of said slide, an insert within and narrower than said bore, means securing the upper end of said pin within said insert, a circumferential groove in said bore, and means carried by said insert and slidably disposed within said groove.

5. A carburetor according to claim 4, said last-mentioned means comprising an O-ring tightly gripping a groove on said insert, the elastic nature of said O-ring serving to isolate harmonic vibrations of said pin with respect to said body and slide.

6. A carburetor according to claim 4, said pin securing means comprising coacting threads on said pin and insert, whereby axial adjustment of the pin with respect to the insert is permitted, and a set screw mounted in said insert and engageable with said pin to hold it in its adjusted position.

7. A carburetor according to claim 4, said slide being provided with a central enlargement, said bore being in said enlargement.

8. A carburetor according to claim 7, said last-mentioned means comprising an O-ring tightly gripping a groove on said insert, the elastic nature of said O-ring serving to isolate harmonic vibrations of said pin with respect to said body and slide, said pin securing means comprising coacting threads on said pin and insert, whereby axial adjustment of the pin with respect to the insert is permitted, a set screw mounted in said insert and engageable with said pin to hold it in its adjusted position, and access openings in said enlargement for said set screw and O-ring.

9. In a carburetor for an internal combustion engine, said carburetor being of the type having a throat through which air passes en route to a combustion chamber in the engine, a throttle slide movable across said throat to regulate flow of air therethrough, and a fuel passage opening into said throat opposite said slide, a pin carried by said slide extending into said fuel passage and movable with said slide into and out of said passage, said pin having fuel metering means associated therewith at one side thereof downstream of said slide for regulating flow of fuel from said passage into the stream of air traversing said throat, an improved mounting connecting said pin to said slide comprising means supporting said pin for universal adjustment radially of the pin axis, whereby said pin positions itself automatically and is disposed in use in alignment with and coaxially to said fuel passage; and means comprising surfaces carried by said pin and said slide and mutually engageable to limit rotation of said pin with respect to said slide, for positively holding said pin in use with said fuel metering means on the downstream side of the pin in adjusted positions of said pin.

10. The combination as set forth in claim 9 wherein said fuel metering means is operable further to regulate flow of fuel into said throat by longitudinal adjustment of said pin in said mounting, wherein said mounting includes two-part means, one part associated with said pin and one part associated with said slide; and thread means interacting between said parts permitting relative movement between the parts and simultaneous longitudinal adjustment of said pin; and wherein the last-mentioned means of claim 10 is further operative to interconnect said parts to hold said pin in a selected longitudinally adjusted position.

11. The combination as set forth in claim 10 wherein the means supporting said pin is in the form of an O-ring confined in confronting inner and outer annular grooves provided in one part of said two-part means and said slide respectively, said O-ring providing a yieldable support for said pin and being operative to permit limited movement of said pin radially in all directions around its circumference.

12. The combination as set forth in claim 10 wherein said parts are rotatable relative to each other on said thread means to adjust said pin longitudinally; and wherein the last-mentioned means of claim 10 is a set screw interconnecting said parts, said set screw extending radially of said pin into an access opening in said slide and being retractable to permit relative rotative movement of said parts on said thread means to adjust said pin longitudinally, the extending portion of said set screw coacting with said access hole to hold said pin selectively rotatably with said fuel metering means at the downstream side thereof.

* * * * *

UNITED STATES PATENT OFFICE

CERTIFICATE OF CORRECTION

PATENT NO. : 4,008,298

DATED : February 15, 1977

INVENTOR(S) : Norman G. Quantz

It is certified that error appears in the above-identified patent and that said Letters Patent are hereby corrected as shown below:

Claim 10, column 8, line 2, "10" should be -- 9 --.

Claim 12, column 8, line 16, "10" should be -- 9 --.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*